United States Patent [19]

Kafarov et al.

[11] 4,149,981

[45] Apr. 17, 1979

[54] METHOD OF PRODUCING PLASTIC AND LIQUID LUBRICANTS

[76] Inventors: Viktor V. Kafarov, ulitsa Vavilova, 48/4, kv. 247; Alexandr V. Kuramzhin, ulitsa Televidenia, 31, korpus 4, kv. 43; Dmitry M. Bodrov, ulitsa Bolotnikovskaya, 42, korpus 3, kv. 19, all of Moscow; Evgeny I. Obelchenko, 34, ulitsa Portovaya, 170 A, kv. 10, Rostov-na-Donu; Adolf A. Chernyavsky, ulitsa Baumana, 20, kv. 6, Rostov-na-Donu; Margarita S. Yaschinskaya, prospekt Stachki, 182/1, kv. 65, Rostov-na-Donu; Dmitry D. Logvinenko, ulitsa Kalinina, 5, kv. 5, Poltava; Oleg P. Shelyakov, ulitsa Kalinina, 5, kv. 100, Poltava; Karl L. Tsantker, ulitsa Lunacharskogo, 4, kv. 5, Poltava; Larisa B. Gladilina, ulitsa Zygina, 29, Poltava, all of U.S.S.R.

[21] Appl. No.: 758,690

[22] Filed: Jan. 12, 1977

[51] Int. Cl.[2] ..... C10M 1/24; C10M 3/18; C10M 5/14; C10M 7/20

[52] U.S. Cl. ..... 252/35; 252/18; 252/25; 252/28; 252/39; 252/41; 366/273

[58] Field of Search ..... 252/18, 41, 28, 25, 252/39, 35; 366/273

[56] References Cited

U.S. PATENT DOCUMENTS

| | | | |
|---|---|---|---|
| 2,870,090 | 1/1959 | Pitman et al. | 252/41 |
| 2,905,448 | 9/1959 | Martinek | 252/41 |
| 2,950,248 | 8/1960 | Armstrong et al. | 252/41 |
| 3,242,088 | 3/1966 | Bright et al. | 252/41 |
| 3,475,335 | 10/1969 | Greene et al. | 252/41 |
| 4,093,189 | 6/1978 | Sokol et al. | 366/273 |

*Primary Examiner*—Irving Vaughn

*Attorney, Agent, or Firm*—Lackenbach, Lilling & Siegel

[57] ABSTRACT

A method for producing plastic and liquid lubricants characterized by conducting a dispersion of the starting components, such as thickeners or reagents for the formation thereof, additives and fillers and base liquids into a vortical bed of ferromagnetic particles formed under the action of a rotating magnetic field.

The proposed method makes it possible to reduce the duration of chemical reactions between the dispersed components of lubricants by thousands of times as compared to the known batch processes and by dozens of times as compared to the known continuous processes. The method provides continuous conduction of technological processes with high productivity, reduces by 10–20% specific consumption of expensive components, by 2–3 times the consumption of energy, and allows the process to be conducted at lower temperatures and pressures.

10 Claims, No Drawings

METHOD OF PRODUCING PLASTIC AND LIQUID LUBRICANTS

The present invention relates to methods of producing plastic and liquid lubricants widely used in transport, machine engineering, instrument making, and metal working for reducing the wear and enhancing service life of engines, mechanisms, and devices, for reducing friction in various units, for corrosion-protective coatings, and for intensifying the processes of metal working.

The main types of lubricants used for the above-cited purposes are plastic (consistent) and liquid lubricants obtained by dispersing various types of thickeners, fillers, and additives in base liquids which are mineral (petroleum) or synthetic oils.

Plastic lubricants fall into the following main types depending on the thickener used:

soap lubricants, used, mainly, as antifriction ones, in which thickeners are soaps, viz. salts of higher fatty acids obtained by neutralization of fatty stock materials with hydroxides of metals; most widely used are lubricants based on calcium, lithium, barium, or aluminum soaps, as well as on mixed soaps, for example, calcium-lead, or barium-aluminum ones;

hydrocarbon lubricants, used mainly, as anticorrosion ones in which thickeners are high-molecular hydrocarbons of normal structure (paraffins), naphthenic, or naphtheno-aromatic hydrocarbons with long side chains (ceresins), their mixtures, and side products of deparaffinization (petrolatums);

inorganic lubricants, often used instead of soap and hydrocarbons, are obtained by thickening oils with the help of inorganic compounds: clays (for example, bentonite), silica gel, asbestos, mica, graphite, carbon black, sulphides, sulphites, oxides and hydroxides of various metals; and by dispersion of pure metals; most widely used are silica gel, bentonite, graphite, and disulphide-molybdenum lubricants;

organic lubricants, high temperature ones, in which for thickening oils use is made of organic compounds, viz. pigments (pigment lubricants), urea derivatives (ureate lubricants); as well as lubricants for operating in agressive media, in which thickeners are solid high-molecular polymers, viz. polyethylene, polyvinyl chloride, polypropylene, and fluorine-containing polymers; as base liquids in such lubricants use is made of polymeric liquids, viz. polysiloxane, polyfluorocarbon, etc. (polymer lubricants).

Various additives (stabilizing, antiscuff, antiwear, anticorrosion, antioxidizing, antiradiation) and solid fillers (antifriction, sealing, loading) are introduced into many plastic lubricants to improve their properties.

Liquid lubricants are of the following types:

lubricating oils used in internal-combustion engines, steam engines, turbines, compressors, etc.; they are obtained by dispersion of various additives in base liquids (petroleum oils and their mixtures);

lubricating compositions used in metal working either directly, or in the form of concentrates for preparing lubricating and cooling emulsions (liquids); these compositions are obtained either by simple dispersion of the components (additives, emulsifiers, etc.) in mineral oils, or by dispersion of the components entering into reaction (for example, saponification), the reaction products being used as additives, emulsifiers, etc.

At present, two main processes of producing lubricants are known, namely, batch and continuous ones. Their combinations as various semi-continuous processes also find application.

Plastic lubricants are produced mainly by batch processes (see, for example a book by Velikovsky D. S., Poddubny V. N., Vainshtok V. V., and Gotovkin B. D. "Konsistentnye Smazki" (Consistent Lubricants) in Russian, "Khimiya" Publishers, M., 1966). The initial components batched in weight or in volume are put into a boiling reactor with a capacity of up to 10 $m^3$ fitted with a device for mechanical stirring. Saponification reaction (for soap lubricants) is conducted up to 100° C. for several hours (sometimes for dozens of hours), then water is evaporated, the soap formed or other thickeners in oils are dispersed and thermally treated. The thermal treatment resides in heating up to 100°–250° C. to obtain melts of thickeners in oils and cooling at a given rate down to 30°–70° C. to establish required crystallization conditions. Cooling of the product is performed either in the boiling reactor or in a special cooler in which simultaneous deaeration of lubricants can be accomplished. In the process of preparing plastic lubricants various additives and solid fillers can be added for the purposes mentioned above. After discharging from the reactor or cooler, some types of lubricants are additionally subjected to mechanical treatment to improve their rheological (volume-mechanical) properties: grinding on rolling machines, treating in slotted, disk, or other homogenizers, colloid mills, etc. Then the finished product is prepacked and wrapped for delivering to consumers. The total duration of the technological cycle of producing plastic lubricants by batch process is from several hours to several days. All the stages, except for deaeration, are usually conducted at atmospheric pressure in unsealed reactors. Sometimes, for intensifying the processes, the saponification reaction is run in autoclaves under a pressure of up to 6 $kgf/cm^2$ and at a temperature of up to 150° C. Deaeration is performed in vacuum apparatus.

The known method of producing plastic lubricants has some essential disadvantages:

the processes are multi-step and time-consuming, which limits the equipment capacity; the processes are power-consuming with nonuniform energy consumption at separate steps; large size and weight of technological equipment; large working areas occupied by technological units involving, usually, several large-sized reactors; poor quality of dispersion, calling for increased specific consumption of expensive components; thickeners, fillers, and additives; high labor consumption; complexity and inefficiency of process automation; arduous conditions for the attending personnel (high temperatures, carcinogenic vapors of oils and of other components, high noise level, possible ejection of hot reaction mass from boiling reactors, etc.).

Many of the above-cited disadvantages are eliminated when lubricants are obtained by continuous processes. Known in the art is one of most advanced continuous technological processes developed by "Texaco", U.S.A. (see, for example, the article by Rosenzweig M. D. "Continuous production of consistent lubricants on compact installations", Chemical Engineering, 1971, v. 78, No. 10, p. 67). The known process resides in that the initial components of a thickener and a portion of base liquid are fed into a reactor at a given ratio. In the reactor 170° C. and 7 $kgf/cm^2$ are maintained. As a reactor, a coil is used heated with steam or hot oil. Continuous circulation of the components through the coil favors their adequate intermixing. The treatment of the components in such a reactor takes 5 minutes. The product discharged from the recirculation cycle goes to a heat exchanger and then, through a valve regulating the pressure in the reactor and heat exchanger, to an evaporation chamber where rarefaction of about 250 mm Hg is sustained. Water vapors are removed from the evaporation chamber through the vacuum line and condensed. The condensate is discharged into the system of waste water treatment. Dehydrated mass is treated in the evaporation chamber for 30 minutes by recirculation through a dispersion valve under a pressure of about 4 kgf/cm$^2$. The mass withdrawn from the evaporation chamber is mixed at a definite temperature with the remaining amount of oil and with additives. To obtain a homogeneous product, the latter is finally dispersed in a third recirculation cycle with a dispersion valve at 105°–107° C. under 7 kgf/cm$^2$. The final product is delivered into reservoirs for storage and then for packing and transportation. This method of producing plastic lubricants also has serious disadvantages:

multiple and time-consuming recirculation of the product with exposure to intensive mechanical effects is not suitable for all types of plastic lubricants: some calcium, lithium, sodium and other lubricants are weakened under such conditions, the ultimate strength is considerably decreased without further thixotropic reduction; the use of a coil as a reactor requires recirculation for obtaining a turbulent flow in which mixing and dispersion of the components is ensured, but recirculation cannot provide complete treatment since part of the product discharged from the recirculation cycle is always mixed with a certain amount of undersaponified (for soap lubricants) and underdispersed components; considerable time of treating the components in the reactor (up to 5 minutes) limits the productivity of the process; insufficient dispersion of thickeners, fillers, and additives in a base liquid makes it impossible to improve lubricant properties and decrease consumption of expensive components as compared to batch process; saponification reactions are performed at elevated temperatures (up to 170° C.) and pressures (up to 7 kgf/cm$^2$); the automatic control of the saponification reaction and, consequently, of the product quality presents difficulty because of elevated temperatures and pressures, and non-steady state processes in the reactor.

Known in the art are semi-continuous processes, the most interesting being that of producing plastic lubricants from dry soaps (see, for example, theses of report by Afanas'ev I. D. Vorob'eva V. A., et al. "Method nepreryvnogo proizvodstva smazok na sukhom myle" (Method of continuous producing lubricants on dry soaps), Proceedings of scientific and technical conference, TsNIITENeftekhim, M., 1970, pp. 35–45). The method consists in that dry soap, obtained by following special technology, and a base liquid are charged together with additives into an apparatus fitted with a mechanical stirrer where dispersion is performed for several hours. This part of the process is a batch one. Then, the dispersion obtained is treated by a continuous method: with the help of a metering pump said dispersion is pumped through a heated unit where it melts, through a cooler where the lubricant crystallizes, and after that through a filter and a homogenizing head ensuring the required rheological properties of the product.

The following disadvantages are inherent in the known semi-continuous process.

the necessity of preliminarily preparing dry soap by a batch method with the help of large-sized reactors and centrifugal sprayers by complex technology with a good deal of manual labor; difficulties in introducing automatic control of the process and of quality of the soap obtained; a great duration of the process of preparing the soap-oil dispersion in the apparatus with the mechanical stirrer; insufficient dispersion, which, as in the previous cases, makes it impossible to decrease consumption of expensive components and improve the quality of the lubricant obtained.

Liquid lubricants are also prepared both by periodic and continuous processes. From the technological standpoint, the preparation of liquid lubricating compositions for metal working is the most complicated process (see, for example, a book by Kurchik N. N., Vainshtok V. V., and Shekhter, Yu. N. "Smazochnye materialy dlya obrabotki metallov rezaniem" (Lubricants for treating metals by cutting) in Russian, "Khimiya" Publishers, M., 1972). Lubricants for these purposes are mainly prepared by batch process. But, due to much higher volume of production, reservoirs of a capacity from 100 to 1,000 m$^3$ are usually used as boiling apparatus. Mixing and dispersion of the components in such reservoirs are performed either by the recirculation method or by bubbling compressed air through the whole bed of the product. Working temperatures do not exceed 100° C.; pressure is atmospheric; cycle duration is from several hours to several days.

All the above-cited disadvantages of batch processes are inherent in this method.

It is an object of the invention to provide a method of producing plastic and liquid lubricants, which will make the process of producing these materials cheaper.

Another object of the invention is to provide a method of producing plastic and liquid lubricants, which will accelerate the process of producing these materials.

A further object of the invention is to provide a method of producing plastic and liquid lubricants which will reduce the consumption of expensive components.

The objects of the invention are accomplished by producing plastic and liquid lubricants by dispersing starting components: a thickener or reagents for the formation thereof, fillers, additives and base liquids, etc. According to the present invention, the dispersion is accomplished in a vortical bed of ferromagnetic particles formed under the action of a rotating magnetic field. Subsequent steps of melting the dispersion, moisture removal, cooling, deaeration and homogenization can also be included.

The proposed method of producing plastic and liquid lubricants makes it possible to reduce by several thousands of times, as compared to the known batch processes, and by several dozens of times, as compared to the known continuous processes, the duration of chemical reactions between the components of lubricants and duration of dispersing these components. The method ensures continuous run of technological processes with high productivity decreases by 10–20% specific consumption of expensive components and by 2–3 times consumption of energy; lowers operating temperatures and pressures.

For a better understanding of the further objects and advantages of the present invention the following detailed description of the method of producing plastic and liquid lubricants and the examples of realizing the method are given hereinbelow by way of illustration.

The proposed method is accomplished in a reactor representing a length of a non-magnetic pipeline around which a system of windings is arranged creating a rotating magnetic field. Non-equiaxial ferromagnetic particles are placed in the reactor; said particles under the effect of the rotating magnetic field are set in a compound motion: each particle travels in the direction of field rotation and, simultaneously rotates precessionally about its smallest axis at a speed of 10,000 r.p.m. Ferromagnetic particles, operating as elementary mechanical stirrers, create a vortical layer filling the whole operating volume of the reactor, and, at the same time, emit acoustic and ultrasonic oscillations of a wide frequency spectrum. In addition, under the action of an alternating magnetic field, ferromagnetic particles emit magnetostrictive oscillations. Eddy currents, arising in the particles as in electric conductors, give rise to rapidly alternating magnetic and electric fields. Due to the combined action of all the above-cited factors, an intensive stirring and dispersion of the components takes place in the working zone of the reactor, at the same time the components are fed into the reactor continuously and at a given ratio. The duration of treating the components in the reactor, even when the saponification reaction (for soap lubricants) takes place, does not exceed several seconds at temperatures no more than 70°-90° C. under atmospheric pressure. The product obtained in the reactor is discharged continuously and delivered to the subsequent stages of treatment, if necessary. Thus, for example, when preparing soap- sodium, lithium lubricants, the dispersion obtained is heated at a temperature of about 160°-250° C. for producing a melt of thickeners in oils with a regular structure; then water is evaporated, deaeration performed, and the product is cooled at a rate ensuring prescribed crystalline structure of the lubricant. After that the lubricants are subjected to homogenation to improve their rheological properties. The ferromagnetic particles are retained by the magnetic field in the working zone of the reactor and do not contaminate the product.

The best effect can be obtained when using non-equiaxial ferromagnetic particles with the ratio between their large and small size within the range from 6 to 20. Various ferromagnetic metals and alloys both magnetically soft and hard, such as carbonaceous steel, nickel, cobalt-nickel alloys, and the like, can be used for preparing particles.

When it is necessary to exclude interaction of aggressive components of the product being treated with the material of the ferromagnetic particles and contamination of the flow with corrosion products and with the materials of the particles, the surface of said particles can be coated with a layer of a polymer insoluble in oils or of other material stable to acids, alkalies, and other aggressive components entering into the composition of the lubricants being produced. As coatings use can be made of polyethylene, polyamide, polyvinyl chloride, fluorinated plastic, and other materials, depending on the required stability of the coating and on the working temperatures. Thus, polyvinyl chloride coatings can be used at temperatures no more than 60°-70° C. At 70°-90° C. satisfactory results are obtained with polyethylene or polyamide; at higher temperatures fluorinated plastic is suitable. Fluorinated plastic coatings are very stable to aggressive components present in the product flow.

To produce a magnetic rotating field, inductors of simplest designs may be used supplied from three-phase alternating current mains of industrial frequency (50 Hz). This allows maximum speed of rotation of the magnetic field to be obtained equal to 3,000 r.p.m. (for the U.S.A. it is possible to use frequency of 60 Hz and speed of rotation 3,600 r.p.m.). The active power consumed does not exceed 4 kW per liter of the working zone of the reactor; a capacity up to 1,000 kg/hr for plastic lubricants and up to 2,000 kg/hr for liquid lubricants can be obtained when one-liter reactor is used. In practice, the working zone of the reactors with the rotating magnetic field may be from half a liter to dozens of liters, depending on the required capacity.

High degree of dispersing the components makes it possible to reduce the amount of thickeners, fillers, and additives by 10-20% as compared to the known methods, the properties of the lubricants obtained being the same or even better.

The characteristics of the initial products which can be used for producing plastic and liquid lubricants by the method proposed in the present invention are given hereinbelow.

Fatty stock material is used in the production of soap lubricants for preparing soaps: stearic acid, 12-oxystearic acid, hydrogenated castor oil, cotton seed oil, talloil, gossypol oil, acidol, vegetable oil, animal fats, hydrogenated fats of fish and sea animals, technical and goudroun fat, synthetic fatty acids, and the like; and hydroxides of metals: lithium, sodium, potassium, magnesium, calcium, zinc, strontium, barium, aluminum, lead, silver, and the like.

Soaps are prepared by neutralization of higher fatty acids with metal hydroxides (alkalies):

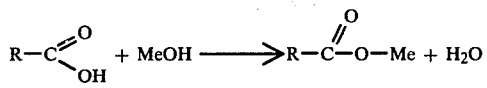

for example,

| | |
|---|---|
| $C_{17}H_{35}COOH + LiOH =$ stearic acid | $C_{17}H_{35}COOL; + H_2O$ lithium soap of stearic acid |

or by saponification of higher fatty acid glycerides with alkalies:

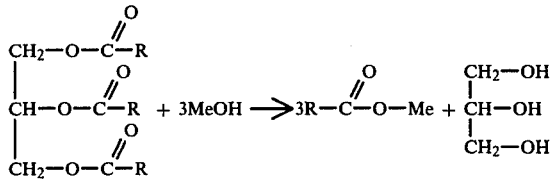

where

R is an aliphatic radical $[(CH_3\text{-}(CH_2)_n]$

Me is a cation of metal.

Paraffin, ceresin, and their mixtures are used as thickeners for hydrocarbon lubricants.

For inorganic lubricants the following thickeners are used: bentonite clay, silica gel, asbestos, mica, graphite, carbon black, oxides, hydroxides, carbonates, sulphites, sulphides, disulphides, and nitrides of various metals, fiberglass and the like, as well as fine powders of pure metals: aluminum, copper, iron, zinc, tin, lead, and of various alloys which are dispersed in oils containing surfactants.

For organic lubricants the following thickeners are applied: pigments (copper indanthrene, copper phthalocyanine, oxazole, isoviolanthrone, etc.;
arylureates (urea derivatives);
alkyl and acyl derivatives of urea, tetraureates;
aminophenols, alcoholates of metals, cellulose, calcium acetate, chelates of cobalt and zinc dithiooxamides, triazine derivatives, copolymers of vinylacetate and ethylene, titanium and zirconium tetraphenylphosphinates. However, only lubricants thickened with the following thickeners have found practical application: phthalocyanine, indanthrene, and other pigments, arylureates, and some polymers: polyethylene, polypropylene, polytetrafluoroethylene, polytrifluorochloroethylene, polyvinyl chloride, and polyamide.

The following additives are introduced into lubricants:
antioxidizing: diphenylamine; tetrabenzylamide of ethylenediaminetetraacetic acid; 2,4-diaminodiphenyl ester; 1-alkylbenzyl-3-phenylureate; acenapht-1,2-α-acenaphthylene; di-tert-butyl-n-cresol; lead and zinc diamyldithiocarbamates; phenothiazine, dilaurylselenide; trisodiumphosphate;
metal deactivators (inhibiting catalytic action of metals on oxidizing processes in lubricants):
(1) passivators forming films on metal surfaces: β-dicyclohexylaminoethylsulphide, triarylalkylphosphate, trialkylphosphate, and the like;
(2) deactivators entering into the reaction with ions of metals with the formation of catalytically inactive compounds: disalicylindeneethylenediamine (trade name Nonoxol CD) imides of oxalic acid, soaps of some metals (chromium, tin, or nickel oleates).

Concentration of deactivators does not exceed 0.001–0.5%. In lithium lubricants free lithium hydroxide acts as a deactivator; anticorrosion additives used in anticorrosion and antifriction lubricants; they must be present in inorganic lubricants: lead, magnesium, or zinc naphthenate, a mixture of barium naphthenates and sulphonates, manganese oleate, amides of benzenepolycarboxylic acids; alkylene-bis(alkylsuccinimide); products of the reaction of organic amines with polymers of unsaturated acids, chromates and bichromates of alkaline and alkaline earth metals and of zinc, sodium nitrite, 1,2,4-triazol in a mixture with 3-amine-1,2,4-triazol, butylstearate, sorbitol monooleate, salts of phosphoric, nitric, and naphthenic acids, derivatives of phenols, wool fat, and products of petrolatum oxidation;
antiscuff and antiwear additives used, mainly in lubricants for heavy-loaded mechanisms. More often use is made of compounds of sulphur, chlorine, phosphorus, salts of molybdic or tungstic acids, cadmium salts of acetic and oxalic acids, lead naphthenates, carbonates of some metals, and the like. Concentration of these additives in lubricants varies from 0.1 to 10%. Among the additives are: sulphurated spermacetic oil;
bis-butylxantogenate, resorsinol sulphides, γ-isomers of hexachlorobenzene, telomers of trifluorochloroethylene, tricresylphosphate, thiobisdichlorophenol, 3,2-chloroethylphosphate, lead naphthenate, antimony diamyldithiocarbamate;
a mixture of calcium sulphonate and bismuth sulphide;
tungsten carbonyl;
sulphonated oxymolybdenum dithiocarbamates;
dicyclohexylamine;
esters of boric acid.

Solid fillers are materials insoluble in oils and incapable of forming a structure; fillers improve properties of plastic lubricants:
antifriction—molybdenum disulphide ($MoS_2$), graphite, polymers (polyethylene, polypropylene, polytetrafluoroethylene), etc.;
sealing (for threaded and gland joints)—powders of soft metals (lead, zinc, copper, and the like);
loading (for increasing density of the lubricants operating, for example, under water in immersible pumps)—lead filings, etc.

Dispersion medium or base liquid constitutes no less than 50–60% of lubricants. Therefore, in spite of the fact that the most important characteristics of lubricants are determined by the type of the thickener, such parameters as viscosity, solidification point, and colloidal stability depend on the oil base used. Petroleum and synthetic oils are usually applied. The great majority of lubricants (99.9%) are prepared with petroleum oils:

| | | |
|---|---|---|
| velocite | viscosity | 4–5 cSt |
| instrument oil | | 6–8 " |
| transformer oil | | 8–9 " |
| spindle oil | | 12–14 " |
| industrial oil | | 10–58 " |
| axle oil | | 22–25 " |
| perfumery oil | | 16–24 " |
| cylinder oil | | 9–13, 32–44 " |
| base oil | | 9–13 " |
| machine oil | | 42–58 " |
| aviation oil | | 80–200 " |
| transmission il | | 350–450 " |

(the names of the oils are for the USSR only, viscosity values are given for +50° C.)

Synthetic oils are used for producing lubricants operating under especially arduous conditions. Such lubricants are produced in small amounts (dozens of tons per year); the lubricants are produced either with pure synthetic oils, or with mixtures of synthetic and petroleum oils. Most widely used synthetic oils are polysiloxanes, esters, synthetic hydrocarbons, polyphenyl esters, polyalkyleneglycols, and halogen derivatives of hydrocarbons.

Polysiloxanes (polymer compounds of silicon and oxygen) are the main type of synthetic oils for high-temperature lubricants operable up to 250°–300° C. Use is made of polydimethyl and polydiethylsiloxanes, polyphenylmethylsiloxanes, and polyfluorosiloxanes.

Also applied are:
esters of dibasic acids,
polyphenyl esters, polyalkyleneglycols, polymers of fluorine-containing hydrocarbons, perfluorotrialkylamines, perfluroalkyl polyesters, etc.

Emulsifiers are introduced into compositions of lubricants used as lubricating and cooling liquids in metal working; among these are ethyl alcohol, water, and polyglycols.

Application of the proposed method of producing plastic and liquid lubricants offers the following advantages:
duration of saponification and dispersion of the components is reduced by several thousands of times as compared to batch processes and by dozens of times as compared to the known continuous processes;

duration of action on the product during treatment in the reactor does not exceed several seconds;
continuous performance of the processes with a high capacity;
technological flow sheet is simplified; size and weight of the equipment and, consequently, working floor areas occupied by it are reduced;
specific power consumption per unit of the produced products is decreased by 2-3 times;
the quality of the dispersion process is increased; a possibility arises of reducing by 10 to 20% specific consumption of expensive components; thickeners, fillers, and additives;
working pressures and temperatures are reduced, which makes it possible to decrease power consumption and increase safety of the processes;
complex automation of the technological processes of producing lubriants becomes possible, including automatic control and regulation of characteristics of the product;
labor conditions are improved and labor productivity is increased.

EXAMPLE 1

To obtain plastic soap lithium lubricant, non-equiaxial ferromagnetic particles, from magnetically soft carbonaceous steel, with a ratio between large and small size equal to 9-11 and with a surface covered by a polyethylene layer are placed into a 0.5-lit. reactor fitted with an electric inductor having an active power of 1.7 kW and supplied from three-phase alternating-current mains at 380/220 V and 50 Hz. The inductor is switched on and a magnetic field is established inside the reactor, said magnetic field rotating at a speed of 3,000 r.p.m. The components are fed into the reactor with the help of a metering device at 76° C., the flow rates of the components being as follows:

| | |
|---|---|
| technical-grade stearin | 44.8 kg/hr; |
| 10% aqueous solution of lithium hydroxide | 36.2 kg/hr; |
| mineral oil with a viscosity of 7 eSt at +50° C. | 392.0 kg/hr; |
| 5% solution of diphenylamine in the same mineral oil | 27.0 kg/hr. |

The soap-oil dispersion formed at a flow rate of 500 kg/hr, from the reactor with the rotating magnetic field, is delivered with the help of a metering pump into a thermal unit. The soap-oil dispersion is melted in the thermal unit at +220° C. under 15 kgf/cm$^2$. The product leaving the thermal unit goes to an evaporator where a rarefaction of 150-220 mm Hg is maintained. Due to a sharp pressure drop, the moisture from the product is completely removed. The product temperature falls down to +150° C. After the evaporator, the product with the help of a second measuring device is fed into a scraper cooler where it is cooled down to +40° C., and then the product passes through a filter and a slotted homogenizer where it is treated under 100-120 kgf/cm$^2$. After that the product is discharged.

The lubricants obtained (465 kg/hr) have the following characteristics:

| | |
|---|---|
| ultimate strength at +50° C. | 4gf/cm$^2$; |
| viscosity at −50° C. and deformation rate 10 s$^{-1}$ | 6,450 poises |
| free alkali content as calculated for NaOH | 0.08%; |

-continued

| | |
|---|---|
| drop point | 178° C.; |
| oxidability (in mg of KOH) | 0.13; |
| colloidal stability | 24.2%; |
| evaporativity | 18.8%; |
| mechanical impurities | none |
| water content | none |
| corrosive action on copper plates at +100° C. for 3 hours | none |

EXAMPLE 2

To obtain plastic soap lithium lubricant, similar to that described in Example 1, a 2-lit. reactor fitted with an inductor having an active power of 7.5 kW and the same type of ferromagnetic particles are used. The flow rates of the components are as follows:

| | |
|---|---|
| technical-grade stearin | 190 kg/hr |
| 10% aqueous solution of lithium hydroxide | 153 kg/hr |
| mineral oil with a viscosity 7 cSt at 50° C. | 1,660 kg/hr; |
| 5% solution of diphenylamine in the same mineral oil | 120 kg/hr. |

The soap-oil dispersion (2,123 kg/hr) formed in the reactor is treated by following the procedure described in Example 1; lubricant is obtained (1,980 kg/hr) with characteristics close to those given in Example 1.

EXAMPLE 3

To obtain plastic soap calcium lubricant, non-equiaxial ferromagnetic nickel particles (with open surface) having a ratio between large and small size equal to 10-12 are placed into a 0.5-lit. reactor fitted with an inductor having an active power of 1.7 kW. The components are fed into the reactor at −80° C. with the following flow rates:

| | |
|---|---|
| synthetic fatty acids $C_{20}$ and higher | 50 kg/hr |
| synthetic fatty acids $C_5$-$C_6$ | 20 kg/hr |
| water | 5 kg/hr |
| lime-oil suspension with lime content of 3 wt. % prepared on petroleum oil with viscosity 20 cSt at +50° C. | 450 kg/hr. |

The final lubricant discharged from the reactor (525 kg/hr) has the following parameters:

| | |
|---|---|
| ultimate strength at +50° C. | 3.4 gf/cm$^2$; |
| viscosity at 0° C. and deformation rate 10 s$^{-1}$ | 1,640 poises |
| free alkali content as calculated for NaOH | 0.1%; |
| water content | 2% |
| mechanical impurities | none |
| corrosive action on steel plates for 3 hours | none |

EXAMPLE 4

To obtain liquid lubricating composition which represents a concentrate for preparing coolant-lubricant emulsions used in metal cutting, unprotected ferromagnetic particles from a magnetically hard alloy with a ratio between large and small size equal to 6-10 are charged into a 0.5-lit. reactor fitted with a 1.7 kW inductor. The components are fed into the reactor at +25° C. with the following flow rates:

| | |
|---|---|
| acidol | 42.5 kg/hr; |
| talloil | 42.5 kg/hr; |
| polyglycols | 8.0 kg/hr; |
| caustic soda | 5.0 kg/hr; |
| water | 15.0 kg/hr; |
| petroleum oil with viscosity 21 cSt at +50° C. | 432 kg/hr. |

The final product discharged from the reactor (545 kg/hr) has the following parameters:

| | |
|---|---|
| total content of organic acids | 9.4%; |
| water and alcohol content | 4.1%; |
| acid number (in mg of KOH per gram of product) | 2.9 mg; |
| stability: separation of oil for 3 hours | 0.1%; |
| corrosive action of 5% water emulsion of product on grey iron for 3 hours | none |

EXAMPLE 5

To obtain liquid lubricating composition which is a concentrate for preparing coolant-lubricant emulsions used in metal cutting, ferromagnetic particles similar to those described in Example 4 are charged into a 2-lit. reactor fitted with a 7.5 kW inductor. The components are fed into the reactor at +45°–50° C. with the following flow rates:

| | |
|---|---|
| gossypol resin | 175 kg/hr; |
| talloil | 175 kg/hr; |
| caustic soda | 25 kg/hr; |
| polyglycols | 38 kg/hr; |
| water | 75 kg/hr; |
| petroleum oil with viscosity 21 cSt at +50° C. | 2,012 kg/hr. |

The final product discharged from the reactor (2,500 kg/hr) has the following parameters:

| | |
|---|---|
| total content of organic acids | 8.8%; |
| water content | 5%; |
| acid number (in mg of KOH per gram of the product) | 4.25; |
| stability: separation of oil for 3 hours | 0.1%; |
| corrosive action of 5% water emulsion of product on gray iron for 3 hours | none |

EXAMPLE 6

To obtain lubricating-cooling liquid which does not require the saponification reaction to be performed, non-protected ferromagnetic particles with a ratio of large size to small equal to 9–11 are put into a 2-lit reactor with a 7.5 kW inductor.

The components are fed into the reactor at +90° C. with the following flow rates:

| | |
|---|---|
| petroleum oil with viscosity 12 cSt at +50° C. | 1,900 kg/hr; |
| petroleum oil with viscosity 160 cSt at +50° C. | 200 kg/hr; |
| phosphatite food concentrate | 20 kg/hr; |
| chlorinated paraffin | 125 kg/hr; |
| 50% solution of zinc dialkyl-dithiophosphate | 250 kg/hr; |
| natural technical-grade sulphur (ground) | 12.5 kg/hr; |
| polymethylsiloxane | 0.14 kg/hr; |

-continued

The final product discharged from the reactor (2.5 ton/hr) has the following parameters:

| | |
|---|---|
| kinematic viscosity at +50° C. | 18 cSt; |
| chlorine content | 2.1%; |
| mechanical impurities | 0.01%; |
| flash point | 182° C.; |
| basicity (as calculated per NaOH) | 1.04%; |
| phosphorus content | 0.4% |
| water content | no |
| corrosive action on steel and pig iron for 3 hours | none |

EXAMPLE 7

To obtain acidic synthetic emulsions by simple dispersion of synthetic fatty acids in oil, non-protected ferromagnetic particles from magnetically soft steel with a ratio of large size to small equal to 10–20 are put into a 25-lit. reactor with a 110 kW inductor.

The components are fed into the reactor at 90° C. at the following flow rates:

synthetic fatty acids $C_{20}$ and higher: 3 ton/hr;

petroleum oil with viscosity 20 cSt at +50° C.: 27 ton/hr.

The final product discharged (30 ton/hr) has the following parameters:

| | |
|---|---|
| acid number (in mg of KOH per gram of the product) | 9.6; |
| stability: separation of oil for 3 hours | 0.2%; |
| water content | 1%; |
| mechanical impurities | none |

We claim:

1. In a method for producing a metal soap plastic lubricant comprising reacting a saponifiable component with a metal base component to form a soap, removing water, contacting said soap with an oil component, heating the soap-oil components, cooling and deaerating to form a metal soap plastic lubricant, the improvement which comprises dispersing said components in a vortical medium of ferromagnetic particles formed under the action of a rotating magnetic field.

2. The method of claim 1, wherein said ferromagnetic particles are non-equiaxial and have a size ratio of large to small particles varying from 6 to 20, respectively.

3. The method of claim 1, wherein said ferromagnetic particles are coated with a layer of material inert with relation to said lubricant components.

4. The method of claim 3, wherein said material is a polymer selected from the group consisting of polyethylene, polyamide, polyvinyl chloride and fluorinated plastics.

5. The method of claim 1, wherein the dispersing of said components is accomplished at a temperature from 25° to 90° C. in a non-magnetic pipeline reactor around which a system of windings is arranged to create a rotating magnetic field.

6. The method of claim 1, wherein said metal soap plastic lubricant is selected from the group consisting of calcium, lithium, barium, aluminum, lead, and mixtures thereof.

7. The method of claim 1, wherein the ferromagnetic particles are non-equiaxial and have a size ratio of large to small particles varying from 9 to 12, respectively.

8. In a method for producing a liquid lubricant comprising contacting components which include base liquids and additives, the improvement which comprises dispersing said components in a vortical medium of ferromagnetic particles formed under the action of a rotating magnetic field.

9. The method of claim 8, wherein said ferromagnetic particles are non-equiaxial and have a size ratio of large to small particles varying from 6 to 10, respectively.

10. The method of claim 8, wherein the dispersing of said components is accomplished in a non-magnetic pipeline reactor around which a system of windings is arranged to create a rotating magnetic field.

* * * * *